US006302443B1

(12) United States Patent
Ashcraft et al.

(10) Patent No.: US 6,302,443 B1
(45) **Date of Patent: *Oct. 16, 2001**

(54) CENTERING CUTS OR TABS FOR BINDER FRAMES

(75) Inventors: Daniel W. Ashcraft, Torrance; Reiko D. Abo, Los Angeles, both of CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/499,150

(22) Filed: Feb. 7, 2000

Related U.S. Application Data

(63) Continuation of application No. 09/056,562, filed on Apr. 7, 1998, now Pat. No. 6,045,161.

(51) Int. Cl.[7] ..... B42D 3/00
(52) U.S. Cl. ..... 281/37; 281/31; 462/73
(58) Field of Search ..... 462/70, 73, 80 R; 281/29, 36, 37

(56) References Cited

U.S. PATENT DOCUMENTS 2,639,168 * 5/1953 Coppock ..... 402/73
5,857,797 * 1/1999 Streff et al. ..... 402/73 X
5,876,143 * 3/1999 Ong ..... 402/73 X
6,045,161 * 4/2000 Ashcraft ..... 402/73 X

* cited by examiner

*Primary Examiner*—Willmon Fridie, Jr.
(74) *Attorney, Agent, or Firm*—Oppenheimer, Wolff & Donnelly LLP

(57) ABSTRACT

A three ring binder includes a spine, a front cover and a back cover, each of which includes a substantially solid base plate and an outer plastic shell. The front cover and spine may each include a front cover pocket and a spine pocket, respectively. A tab assembly is slideably mounted within at least the front cover pocket, and the pocket is formed from a transparent plastic sheet such that the tab assembly is viewable through the transparent sheet. The tab assembly may include a support sheet and display sheet. The display sheet may be any type of information or display material as long as it is dimensionally smaller than the support sheet. The support sheet is dimensionally slightly smaller than the pocket so that it can be slidingly inserted into the pocket. The support sheet includes a plurality of tabs, and the display sheet overlies the support sheet and is positioned underneath each of the tabs such that the display sheet is supported and held in a fixed display location relative to the support sheet. A frame may be provided to overly the outer peripheries of both the display sheet and support sheet, and performs a framing function and also conceals the tabs. The frame may be an integral part of the binder or may be a supplemental sheet forming part of the tab assembly.

22 Claims, 4 Drawing Sheets

38
134
136
44
146
44
44
44
44
44
100
104
128
112
108
24
14
106
18
102
22
12
26

134
44
108
106
100
104
38
128
14
112

44
18
136
26
102
12

CENTERING CUTS OR TABS FOR BINDER FRAMES

This application is a Continuation of application Ser. No. 09/056,562, filed Apr. 7, 1998, which Now U.S. Pat. No. 6,045,161 application(s) are incorporated herein by reference.

FIELD OF THE INVENTION

This invention relates to a tab assembly for supporting a display sheet in a fixed position relative to a support sheet. The invention is applicable to a loose leaf binder for sheets of paper or other material and particularly to a multiple ring binder for the releasable binding of reports, records, and like assemblies of papers, films and the like.

BACKGROUND OF THE INVENTION

Documents and other sheet-like elements are often bound in a supporting binder. Ring binders are widely used for holding a plurality of interrelated documents and records. The loose leaf documents are easily inserted and removed, and the binder is readily reused if the content is no longer needed. In sales presentations and business reports, a professional presentation of the bound material is desirable. Such binders should present the subject matter in a pleasing and interesting manner. Reports and sales presentations in particular may require an assembly of certain documents in a predetermined order to be presented and discussed or reviewed. Generally, three ring binders are used in such circumstances. These binders have a spine or base hingedly connected to front and back covers. The spine or base may be a solid backing member to which a ring assembly is secured. The front and back covers may be formed of a relatively flexible material, or of a relatively solid material interconnected to the spine or base through a suitable flexible connection therebetween.

Several devices are currently available to identify the binder and its contents without opening the binder and viewing its contents. However, none of the devices thus far have proved satisfactory. One attempt to satisfy the needs discussed above is disclosed in U.S. Pat. No. 2,852,275 (Brook). This patent describes a binder having a transparent cover plate and a card holding frame built into the front cover of the binder. The frame has several securing slots, and the transparent cover plate has several securing lugs. A card or label is placed within the frame, and the transparent cover plate is positioned overlying the card or label such that the securing lugs of the transparent cover plate are inserted into the slots of the frame. Due to the relatively small size of the card or label, only a limited amount of information such as the title and a brief description of the contents, ownership or the like can be displayed.

A frame assembly described in U.S. Pat. No. 4,164,085 (Steeb et al.) provides for a somewhat larger display sheet on the front cover of the binder. In the Steeb et al. patent, the binder has a frame assembly imbedded in its front cover for displaying a photograph or the like. A photograph-receiving tray which forms a part of the frame assembly is disposed within a complementally configured blind opening in the cover and is supported by a backing member of the cover along the bottom of the blind opening. The tray is adapted to releasably retain a frame in abutment with the outer surface of the cover for holding the desired photograph in a displayed position on the cover. Although the Steeb et al. patent allows the display of a much larger display sheet than the Brook patent, it is still preferable to have the option to provide larger display sheets.

Reference is also made to U.S. Pat. No. 1,779,069 (Lane) in which slits are provided in a mounting sheet at the comers of the display sheet. In this construction, however, the display sheet may bow out from the mounting sheet, between the comers thereof.

The need to present larger display sheets has been addressed in a binder where a clear plastic outer sheet is attached to the cover and/or spine with an open top edge through which a display sheet may be inserted. This allows the presentation of a display sheet as large as the front cover of the binder. These two prior arts have addressed the problem of accepting display sheets which have dimensions as large as the front cover of the binder, but they have not addressed the need to allow the flexibility of presenting display sheets which are also smaller than the front cover. It is generally difficult to properly position a display sheet in the pocket when the display sheet is smaller than the front cover and/or pocket. When the display sheet is placed in the desired position, it will have a tendency of eventually shifting to an undesired position.

The problem of presenting display sheets smaller than the front cover and/or pocket is resolved to a limited extent by providing a mount mat assembly which includes a mount mat and a display sheet. The mount mat substantially corresponds to the size of the pocket, and an appropriate display sheet is affixed to the mat by glue, tape, or some other securing means. The mount mat assembly is then inserted into the pocket. With the mount mat assembly corresponding to the size of the front cover and/or pocket, the display is maintained in the desired registry within the front cover and/or pocket. The problem with the mount mat assembly is that it is often difficult to properly align the display sheet relative to the mount mat. Another problem is that the display sheet can not be readily replaced with another display sheet due to the relatively permanent securement of the display sheet onto the mount mat. If less permanent methods are used to secure the display sheet onto the mount mat, there is a greater likelihood that the display sheet will shift.

Thus, there remains a need for presenting display sheets on a binder in a reliable and rugged manner while maintaining a highly professional and pleasing exterior presentation of the display sheet, as well as permitting easy assembly and disassembly of the tab assembly.

BRIEF SUMMARY OF THE INVENTION

In accordance with the present invention, a tab assembly for supporting a display sheet in a fixed position relative to a support sheet is provided. The tab assembly is particularly suited for any type of loose leaf binder in which a display sheet can be presented on its front cover and where the display sheet is smaller than the dimensions of the front cover. The present invention achieves the objective of presenting a display sheet on a binder in a reliable and rugged manner while maintaining a highly professional and pleasing exterior presentation of the display sheet, as well as permitting easy assembly and disassembly of the tab assembly.

The tab assembly of the present invention is particularly directed to a loose leaf type binder having a solid front and back cover interconnected to a solid spine through a flexible interconnection. Generally, in accordance with a preferred illustrative embodiment of the present invention, the binder spine, the front cover and the rear cover each includes a solid base plate which is covered by a plastic shell. The binder includes a front cover pocket having dimensions substantially corresponding to the dimensions of the front cover, wherein the outer edges of the front cover pocket is secured to the front cover and/or the spine except along a portion defining an insert opening between the front cover pocket and the front cover. The insert opening is of a sufficient dimension to permit the insertion of the tab assembly between the front cover and the front cover pocket. In a preferred construction, the front cover pocket may be formed from a transparent plastic sheet such that the entire tab assembly may be viewable through the transparent sheet.

The tab assembly may comprise a support sheet and display sheet. The tab assembly may carry any type of information or display material in the form of the display sheet as long as the display sheet is dimensionally smaller than the support sheet. The support sheet has dimensions slightly smaller than the size of the front cover pocket so that it can be slidingly inserted into the front cover pocket. The support sheet has a plurality of inwardly directed tabs for supporting the display sheet in a fixed display location relative to the support sheet. The display sheet overlies the support sheet and is positioned underneath each of the tabs such that the display sheet is supported in a fixed display location relative to the support sheet. Preferably, at least three tabs are employed, and these may be located on opposed sides, or three sides, or on all four sides of the display sheet.

The front cover pocket may also include a presentation frame. Visually, the presentation frame may be blended into the exterior surface of the front cover pocket to appear as an extension of the outer surface of the front cover. The presentation frame can be welded or otherwise bonded to the front cover, and the top side of the presentation frame is not sealed to the front cover such that a top insert opening is provided through which a tab assembly may be inserted within the front cover pocket. However, the insert opening may be formed on the vertical sides or the bottom side of the presentation. The tab assembly for this embodiment can be substantially similar to the tab assembly described above with the exception that a frame is not required.

In accordance with a further aspect of the invention, a display sheet may be mounted on a larger support sheet by a plurality of inwardly directed tabs cut into the support sheet; and these tabs may be located on opposed sides, or three sides, or on all four sides of the display sheet.

In accordance with another feature of the invention, a presentation frame may be provided.

The presentation frame has outer dimensions which may substantially correspond to the outer dimensions of the support sheet such that the frame overlies the outer peripheries of both the display sheet and support sheet, and provides a framing function and also conceals the tabs.

Other objects, features, and advantages of the present invention will become apparent from a consideration of the following detailed description.

DETAILED DESCRIPTION OF THE PREFERRED EMBODIMENTS

Figure 1:
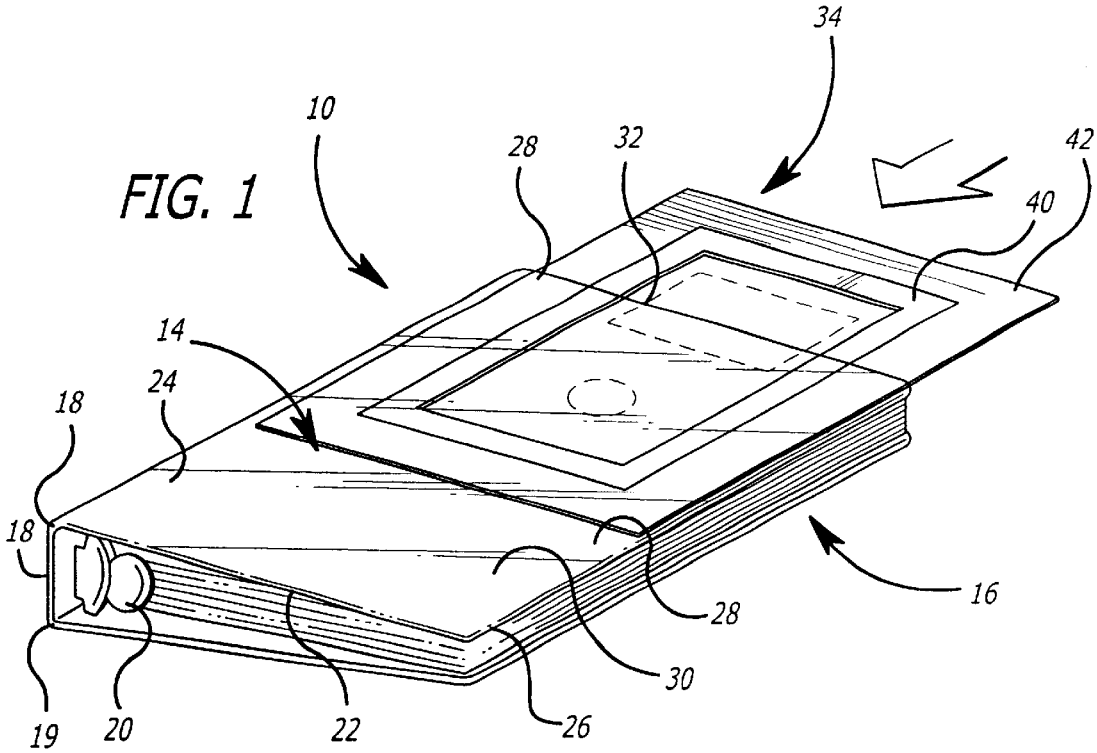
FIG. 1 is a perspective view of a ring binder having a transparent pocket covering the front cover, and a tab assembly sheet partially inserted into the transparent pocket.

The present invention relates to a tab assembly which supports a display sheet in a fixed position relative to a support sheet. The tab assembly is suited for any type of loose leaf binder for sheets of paper or other material in which a display sheet can be presented on its front cover. In the particular embodiment shown in the drawings and herein described, the binder is a three ring binder for the releasable binding of reports, records, and like assemblies of papers, films and the like. However, it should be understood that the principles of the invention are equally applicable to virtually any form of binder. Therefore, it is not intended to limit the principles of the present invention to the specific embodiments shown and such principles should be broadly construed.

Referring to FIG. 1, a three ring binder 10 of a standard size for 8½ inches by 11 inches sheets is illustrated, including a spine 12, a front cover 14 and a back or rear cover 16 connected to the opposite edges of the spine 12 by hinges 18, 19. The front and back covers 14, 16 have a width of about 10 inches and a height of about 11½ inches, and the spine may have a width of about 1¾ inches. The three ring binder 10 has rings 20 adapted to be opened for receiving sheet-like material having spaced holes along the inner edge for alignment with the rings 20.

Many other types of binders exist such as binder having more or less than three rings. The rings may be formed of a metal such as steel or a light weight and inexpensive material such as a plastic. The binder may also be sized to accommodate sheets larger or smaller than 8½ inches by 11 inches. For example, typical carry-type organizers and calendars are usually about 5 inches by 7 inches, while binders for engineering drawings are often about 11 inches by 17 inches. The covers for the binder can also have various configurations. For example, a binder may have three covers of approximately equal size hinged together along the opposite lateral edges of the central cover, and one of these hinged areas includes the rings. The present invention is intended to work equally well with these and other types of binders.

In the particular embodiment shown in the drawings and herein described, the spine 12, front cover 14 and back cover 16 are each formed of a substantially solid and continuous construction. The front cover 14 includes an inner substantially solid base plate (not shown) of paper board or other suitable material. The plate extends substantially throughout the complete width and height of the front cover 14. A decorative and utilitarian plastic cover enclosure or shell is fabricated enclosing the base plate. The shell includes an inner plastic sheet 22 and an outer plastic sheet 24 extending over the base plate. The outer edges of the sheets 22, 24 extend slightly beyond the base plate and are joined and sealed to each other to form a lip 26. The inner edge of the sheets 22, 24 merge into and are integrally formed with the adjacent hinge 18. In addition, the inner and outer plastic sheets 22, 24 of the shell correspondingly extend over the spine 12, the back cover 16 and hinge 19 to define the outer shell of the three ring binder 10, including the lip 26. In this embodiment of the present invention, the inner and outer plastic sheet material 22, 24 is 12 gauge polyvinyl chloride, 0.012 inch thick.

The construction of the binder 10 is not limited to the above description. The shell can comprise of a cosmetically appealing woven fabric instead of the plastic cover described above. In another type of binder, the paper board base plate can be replaced with a visually appealing solid or flexible plastic sheet material which does not require a shell. Reference is hereby made to U.S. patent application Ser. No. 08/978,553 filed Nov. 26, 1997 describing the construction of a three ring binder, and the disclosure of that application is hereby incorporated by reference in this application.

In accordance with the teaching of the present invention, the illustrated embodiment includes a front cover pocket 28 which extends to the outer edges of the front cover 14 such that the dimensions of the pocket 28 are substantially the same as the outer dimensions of the front cover 14. The front cover pocket 28 comprises a transparent plastic sheet 30 secured to the front cover 14.

In the illustrated embodiment, the opposite side edges and the bottom edge of the transparent plastic sheet 30 project outwardly into merged engagement with corresponding hinge 18 and lip 26 of the shell, and are welded or otherwise bonded thereto. The transparent plastic sheet 30 can be welded or bonded to the front cover 14 simultaneously with the welding or bonding of the inner and outer plastic sheets 22, 24 over the base plate. In this embodiment, the inner and outer plastic sheets 22, 24 and transparent plastic sheet 30 are heat and pressure bonded by high frequency welding. The top side of the front cover pocket 28 is left unsecured to the front cover 14 to define a top insert opening 32. A tab assembly 34 can be inserted into the front cover pocket 28 through the top insert opening 32.

In this embodiment of the present invention, the transparent plastic sheet 30 is formed of polyvinyl chloride which is about 0.007 inch thick, but may also be formed of other transparent plastic material such as a polyolefin material. The transparent plastic sheet 30 is formed of 7 gauge polyvinyl chloride, 0.007 inch thick. It is contemplated that the transparent plastic sheet 30 may be between 0.004 and 0.015 inch thick in preferred embodiments.

One of the problems encountered with display sheets which are smaller than the pocket is the difficultiness of positioning and fixing the display in a desired position relative to the front cover pocket 28. In other words, the display sheet is often undesirably positioned off-centered, or when the display sheet is centered correctly, it becomes unsecured and shifts to a different position. In order to more easily position and secure the display sheet, the tab assembly is provided.

Referring now to FIGS. 2–5, the tab assembly 34 is shown. The tab assembly 34 includes a support sheet 36, display sheet 38, internal frame 40 and external frame 42. The tab assembly 34 may carry any type of information or display material in the form of the display sheet 38. The display sheet 38 illustrated in the figures is a 8½ inches by 11 inches sheet. The internal frame 40 is provided primarily for aesthetic purposes, and may be of a contrasting color to focus attention on the inner display sheet.

Figure 4:
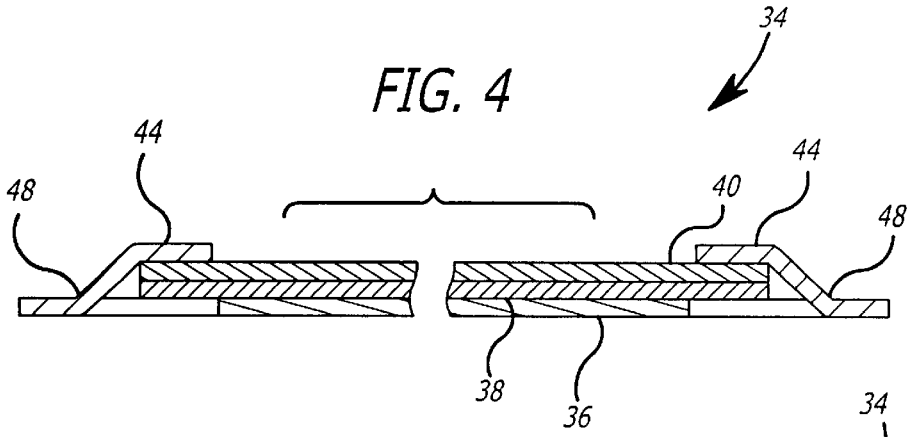
FIG 4. is a cross-sectional view taken through the tab assembly along line 3—3 of FIG. 3 and with the thickness of the sheets increased for descriptive purposes.
Figure 5:
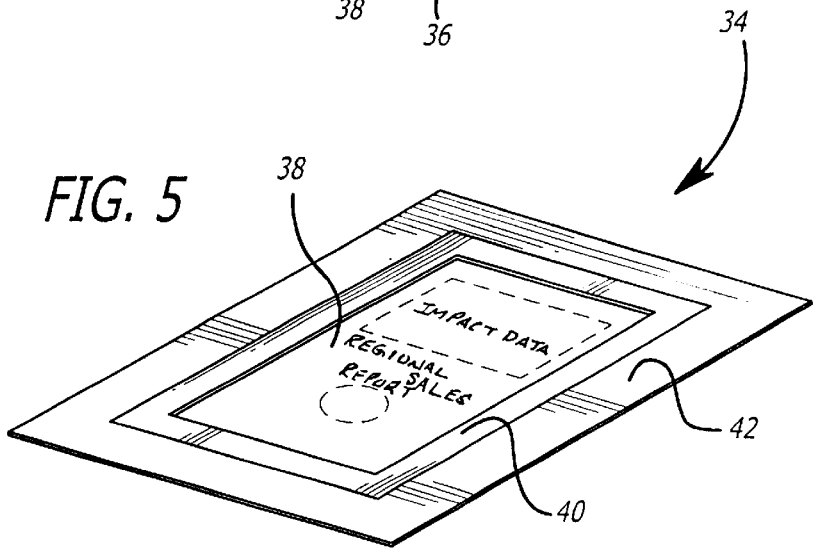
FIG. 5 is a perspective view of the tab assembly shown in FIG. 2 ready to be inserted into the transparent pocket of the ring binder.
Figure 2:
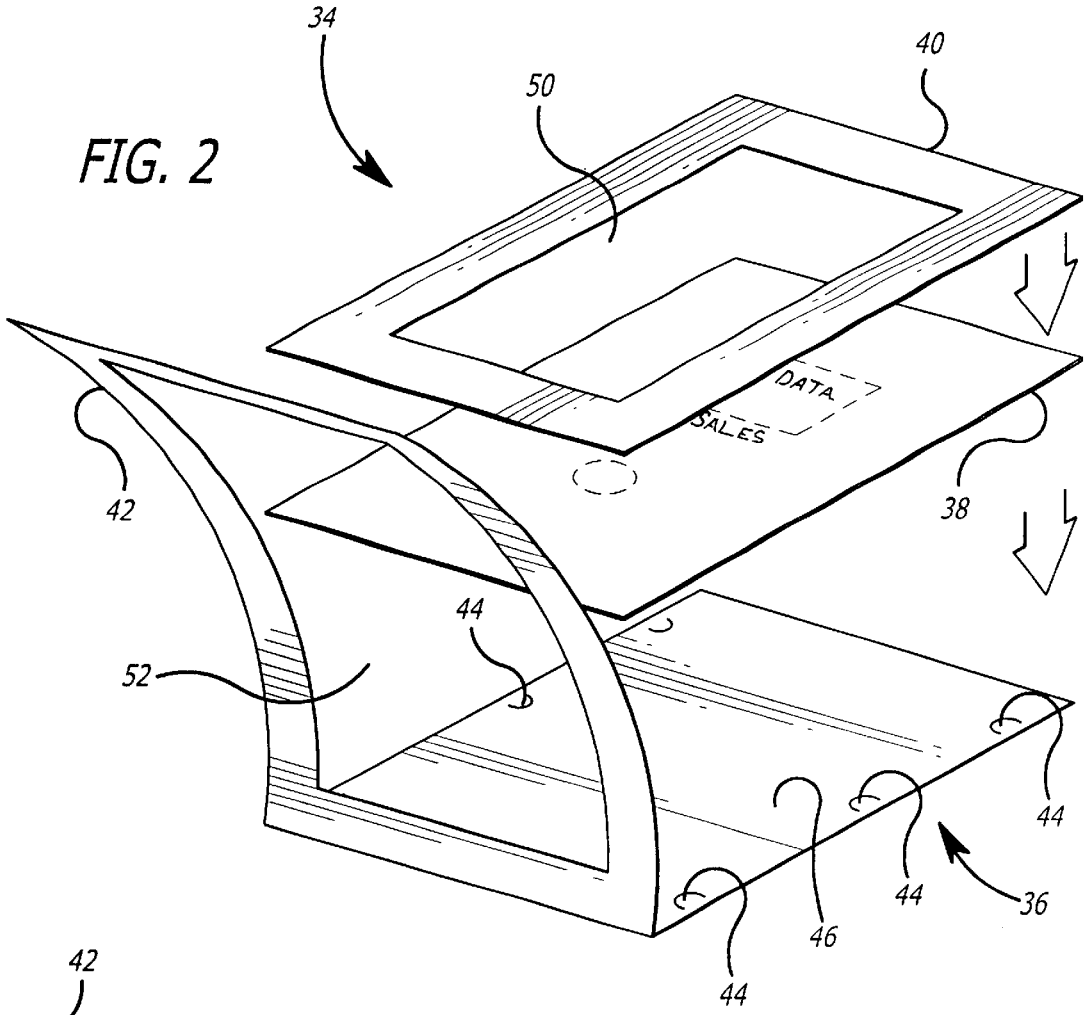
FIG. 2 is an exploded perspective view of the tab assembly having a support sheet, display sheet, and two frames.
Figure 3:
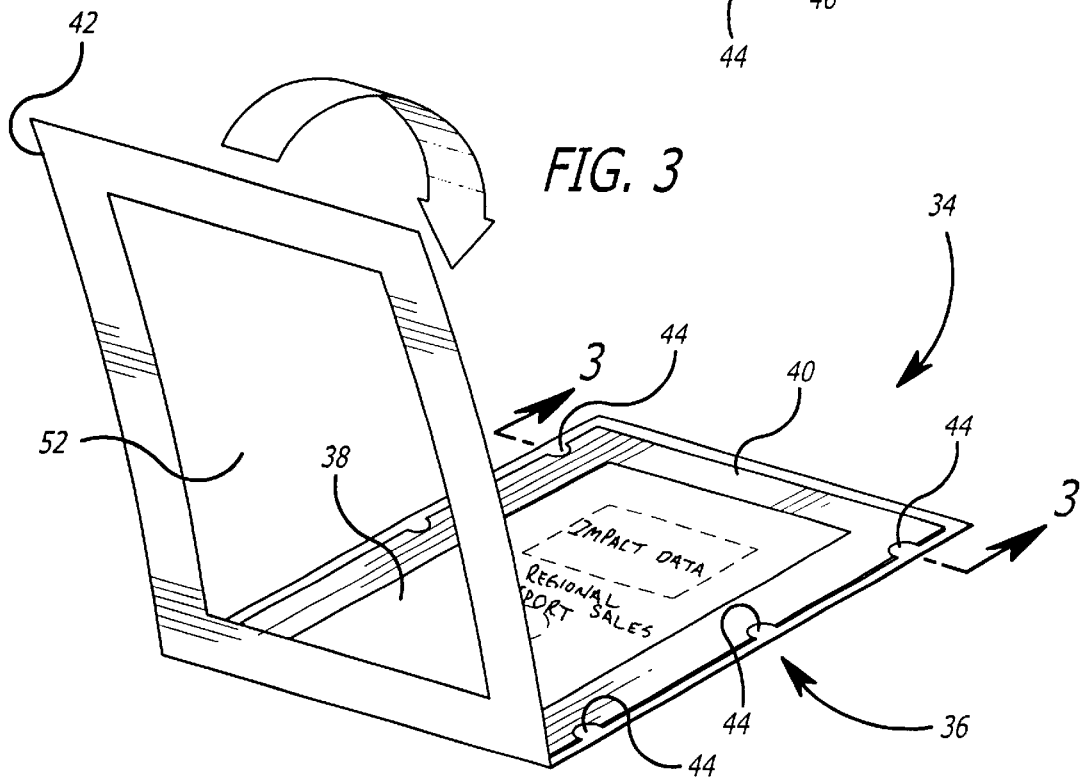
FIG. 3 is a perspective view of the tab assembly shown in FIG. 2 with the display sheet overlying and supported by the support sheet, and one of the frames overlying the display sheet.

The support sheet 36 as shown in FIGS. 2 and 4 has dimensions slightly smaller than the size of the front cover pocket 28 so that it can be slidingly inserted into the front cover pocket 28. The display sheet 38 is substantially smaller than the support sheet 36, and the support sheet 36 has a plurality of centering tabs or cuts 44 for supporting the display sheet 38 and holding it in a fixed display location relative to the support sheet 36. In the illustrated embodiment, the display sheet 38 is centered relative to the support sheet 36, and as a result, the display sheet 38 is also centered relative to the front cover 14 of the binder 10. However, the display sheet 38 can be positioned anywhere on the support sheet 36 by placing the tabs 44 at the appropriate locations. The internal frame 40 has dimensions about the same as the display sheet and is also supported and held in the same fixed location by the tabs 44 of the support sheet 36. The external frame 42 covers the outer peripheries of both the display sheet 38 and the internal frame 40, and provides a framing function and also conceals the tabs 44. As shown in FIGS. 2 and 3, the external frame 42 is integrally formed with the support sheet 36 and folds over the internal frame 40, display sheet 38, and support sheet 36 about the bottom side of the support sheet 36. The external frame 42 can also be formed as a unit separate from the support sheet 36 if desired.

The support sheet 36 may be constructed of a semi-solid paper or cardboard having sufficient column strength for ready insertion and removal from the front cover pocket 28. In this regard, the support sheet 36 is preferably constructed of stiff paper such as an eight pound stock with grain extended in a vertical direction rather than in a horizontal direction. The vertical grain orientation limits paper curling within the front cover pocket 28 and promotes the easy insertion and removal of the support sheet 36. The support sheet 36 can also be formed from a plastic or other resilient material if greater durability is desired.

In the illustrated embodiment of FIGS. 2–4, the semi-circular shaped tabs 44 are cut into the base 46 of the support sheet 36 and are positioned at the peripheral comers of the base 46. Additional tabs 44 are positioned in between the corner tabs 44 along the vertical sides of the support sheet 36. The tabs 44 may also be shaped rectangularly, arcuately, triangularly, or any other appropriate shape. The tabs 44 have base portions 48 coupled to the base 46 of the support sheet 36. The base portions 48 of the tabs 44 are separated along the width of the support sheet 36 by a distance which corresponds to the width of the display sheet 38 so that the display sheet can be properly secured. In the case of this illustrated embodiment, the base 48 of the tabs 44 are separated approximately 8½ inches along the width of the support sheet 36. In this embodiment, the comer tabs 44 are separated length-wise slightly less than 11 inches. For display sheets 38 which are sufficiently stiff, the tabs 44 may be located further inboard along the edge of the display sheet 38. The display sheet 38 overlies the support sheet 36 and is positioned underneath each of the tabs 44 such that the display sheet 38 is supported and held in a fixed display location relative to the support sheet 36. The positioning of the display sheet 38 relative to the support sheet 36 and tabs 44 can be seen in the cross-sectional view of FIG. 4 taken through the tab assembly 34 along line 3—3 of FIG. 3.

The internal presentation frame 40 has outer dimensions which substantially correspond to the outer dimensions of the display sheet 38 such that internal frame 40 overlies the display sheet 38 and is positioned underneath the tabs 44 of the support sheet 36 (see FIG. 4). In the illustrated embodiment of FIGS. 1–5, the internal frame has outer dimensions approximately 8½ inches by 11 inches. The vertical sides of the internal frame 40 have a slightly shorter width than the top and bottom sides and define a presentation opening 50 within the central portion of the display sheet 38. The vertical sides are approximately 1 inch wide, and the top and bottom sides are approximately 1½ inches wide.

The external frame 42 illustrated in FIGS. 1–5 has outer dimensions which substantially correspond to the outer dimensions of the support sheet 36. In this illustrated embodiment, the external frame 42 is formed integrally with the support sheet 36, such that external frame 42 and support sheet 36 are formed from a single sheet having dimensions approximately 8½ inches by 22 inches. In order to have a portion of the internal frame 40 viewable for aesthetic reasons, the central portion of the external frame 42 is cut out to define a presentation opening 52 larger than the presentation opening 50 of the internal frame 40. In this embodiment, the central portion of the external frame 42 is cut out to define a frame with all of its sides approximately 1¼ inches wide. The external frame 42 is positioned above the support sheet 36, display sheet 38, and internal frame 40 by folding the support sheet/external frame structure 36, 42 about a hinged element 54 located at the bottom side edges of the support sheet 36 and external frame 42.

The spine 12 may include a spine pocket (not shown) covering the spine 12. The spine pocket may extend to the outer edges of the spine 12 such that the dimensions of the spine pocket are substantially the same as the outer dimensions of the spine 12. The transparent plastic sheet 30 for the front cover pocket 28 can extend over the spine 12 to form the spine pocket. The opposite side edges and bottom edge of the transparent plastic sheet 30 may project outwardly into merged engagement with the corresponding hinges 18, 19 and lip 26 of the shell, are welded or otherwise bonded thereto. The transparent plastic sheet 30 can be welded or bonded to the spine 12 simultaneously with the welding or bonding of the inner and outer plastic sheets 22, 24 over the base plate. The top side of the spine pocket is left unsecured to the spine 12 to define a top insert opening. A spine tab assembly for the spine pocket can be inserted in the pocket through the top insert opening.

The spine tab assembly (not shown) in this embodiment is similar to the tab assembly 34 for the front cover pocket 28 with the exception that the support sheet, display sheet, internal frame and external frame are dimensioned to slidingly fit into the spine pocket.

Figure 6:
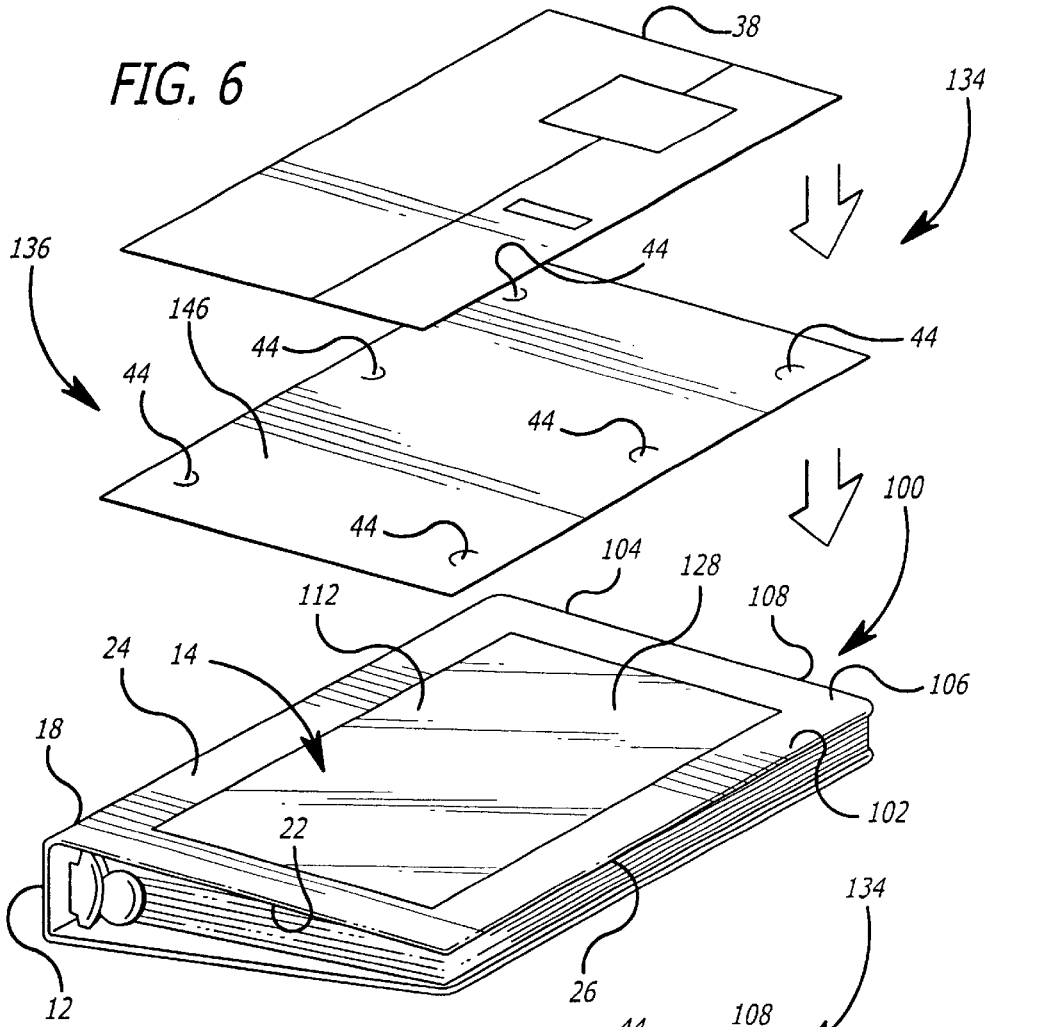
FIG. 6 is an exploded perspective view of an alternative embodiment of a ring binder having both a transparent pocket and an integral frame covering the front cover, and a tab assembly having a support sheet and a display sheet.
Figure 7:
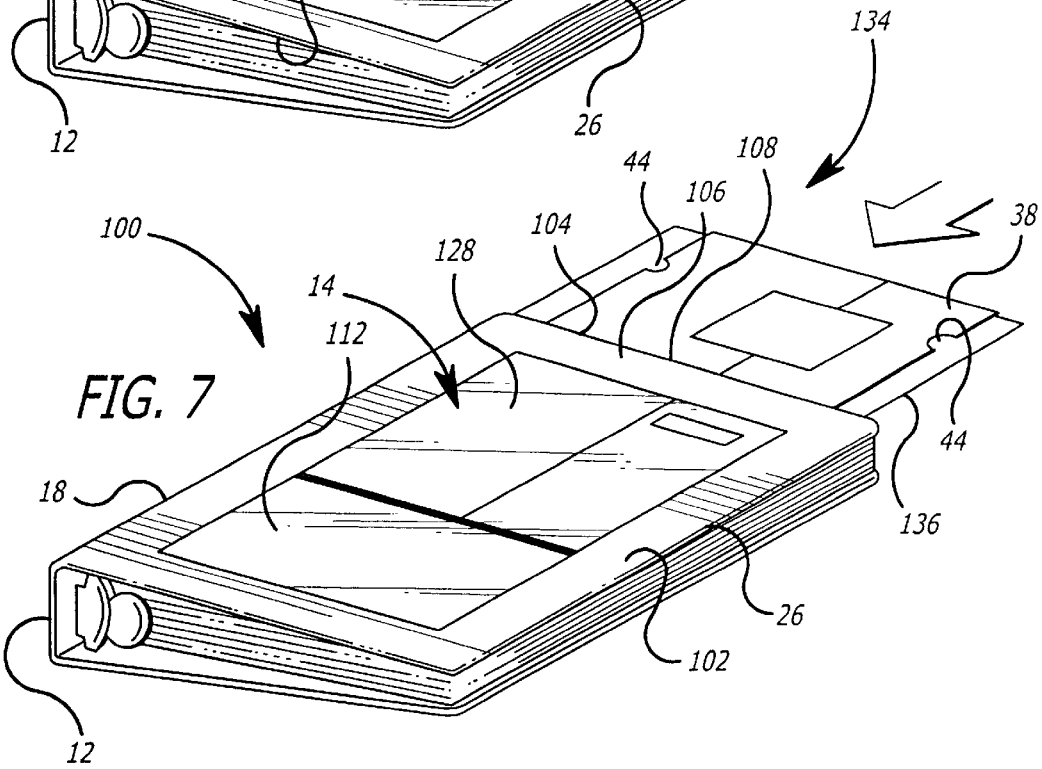
FIG. 7 is a perspective view of the tab assembly shown in FIG. 6 partially inserted into the pocket of the ring binder.

Referring now to FIGS. 6 and 7, a second embodiment of a three ring binder 100 with its accompanying tab assembly 134 is shown. The three ring binder 100 illustrated in this embodiment is similar to the binder 10 discussed above with the exception that the binder 100 has a front cover pocket 128 which includes a presentation frame 102. The top and bottom portions of the presentation frame 102 have a slightly shorter width than the vertical sides and define a presentation opening 104 within the central portion of the front cover 14. However, the frame may have sides of equal width, or the top and bottom sides may have a slightly longer width than the vertical sides.

Visually, the presentation frame 102 may be blended into the exterior surface of the front cover 14 to appear as an extension of the outer surface. In the illustrated embodiment, the presentation frame 102 is similarly formed of a sheet-like plastic, which may be formed of the identical material and color as the shell enclosing the base plate or any desired contrasting color or colors. The opposite side edges of the presentation frame 102 and the bottom edge of the presentation frame 102 project outwardly into merged engagement with the corresponding sealed edges of the lip 26 and hinge 18 of the shell, and are welded or otherwise bonded thereto. The presentation frame 102 can be welded to the front cover 14 simultaneously with the welding of the inner and outer plastic sheets 22, 24 over the base plate. The top side 106 of the presentation frame 102 is not sealed to the front cover 14 and provides a top insert opening 108 through which the tab assembly 134 may be inserted within the presentation frame 102.

The top side of the presentation frame 102 has its upper edge spaced inwardly from the upper lip 26 of the shell to define and locate the insert opening 108. Additionally, the top side of the presentation frame 102 is fabricated with a slight inward curvature such that the upper edge is biased into engagement with the front cover 14 and forms a substantially invisible insert opening 108.

The embodiment illustrated in FIGS. 6 and 7 also has a transparent plastic sheet 112 secured to the interior surface of the presentation frame 102 to provide a clear view of the display sheet 38. The transparent plastic sheet 112 can be secured to the interior surface by adhesive bonding, welding, or other securing means.

The tab assembly 134 is shown in FIGS. 6 and 7 and includes a support sheet 136 and the display sheet 38. The support sheet 136 is substantially the same as the support sheet 36 discussed in the previous embodiment with the exception that an external frame is not formed integrally with the base 146 of the support sheet 136. The display sheet 38 overlies the support sheet 136 and is positioned underneath each of the tabs 44 such that the display sheet is supported and held in a fixed display location relative to the support sheet 136. In the illustrated embodiment, the display sheet 38 is centered relative to the support sheet 136, and as a result, the display sheet 38 is also centered relative to the front cover 14 of the binder 100. The presentation frame 102 covers the periphery of the display sheet 38 and provides a framing function and also conceals the tabs 44.

The embodiment illustrated in FIGS. 6 and 7 may include a spine pocket (not shown) and a spine tab assembly (not shown) which are similar to the front cover pocket 128 and the tab assembly 134 for the front cover pocket 128 with the exception that they are dimensioned to correspond with the dimensions of the spine 12.

Figure 8:
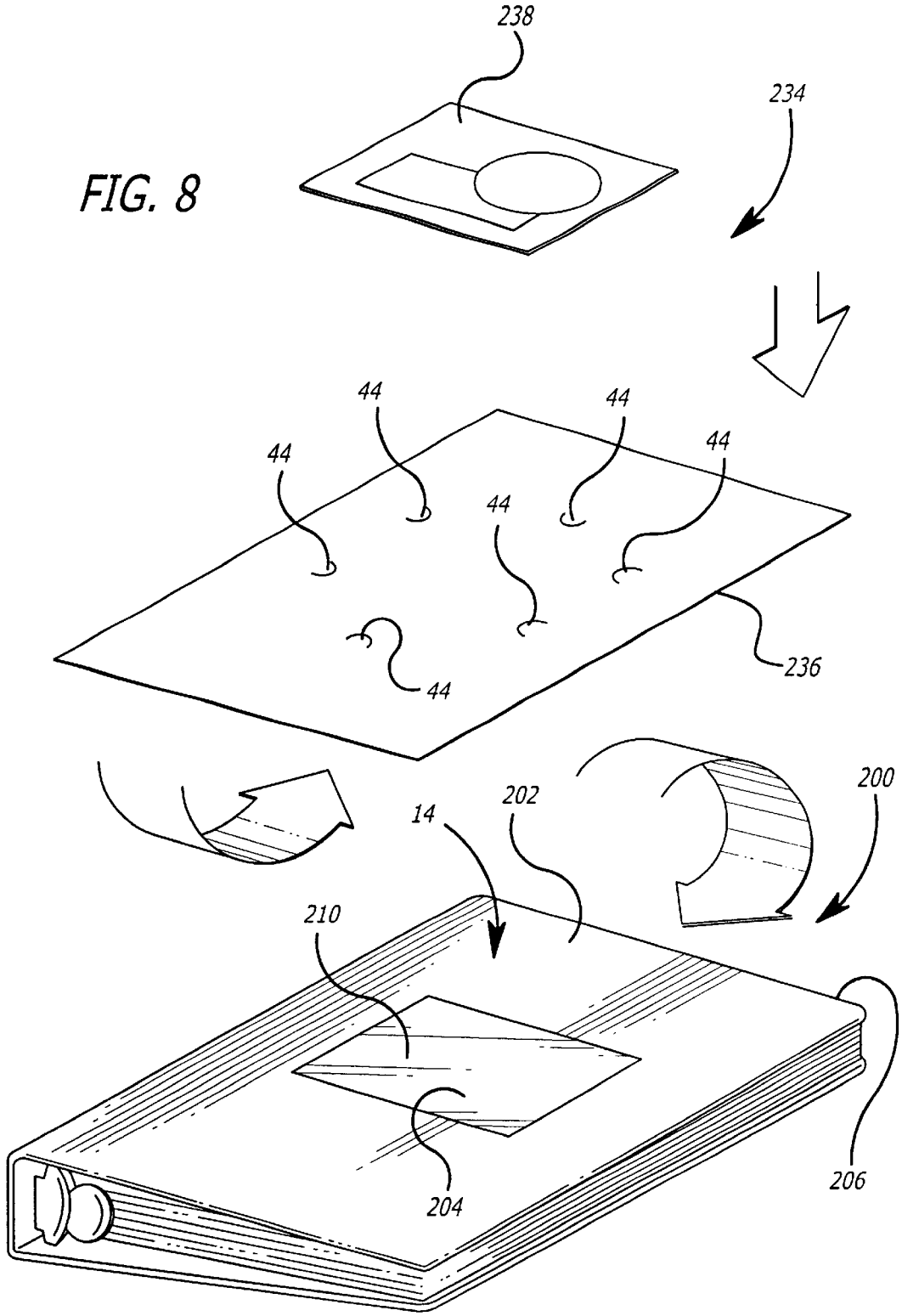
FIG. 8 is an exploded perspective view of another alternative embodiment of a ring binder having a pocket with a smaller transparent window, and a tab assembly having a support sheet and a display sheet.

Referring now to FIG. 8, a third embodiment of a three ring binder 200 with its accompanying tab assembly 234 is shown. The three ring binder 200 illustrated in this embodiment is similar to the second embodiment with the exception that a presentation frame 202 covers a larger portion of the front cover 14 to provide a proper framing for a smaller display sheet 238. In this embodiment, the display sheet 238 is a photograph about 4 inches by 5 inches.

The vertical sides of the presentation frame 202 have a slightly shorter width than the top and bottom portions and define a presentation opening 204 within the central portion of the front cover 14. The presentation opening 204 is dimensioned smaller than the display sheet 238 so that the presentation frame 202 covers the periphery of the display sheet 238, and provides a framing function and also conceals the tabs 44. The top side of the presentation frame 202 is not sealed to the front cover 14 and provides a top insert opening 206 through which the tab assembly 234 may be inserted within the presentation frame 202. A transparent plastic sheet 210 is secured to the interior surface of the presentation frame 202 to provide a clear view of the display sheet 238.

The tab assembly 234 is similar to the tab assembly 134 of the second embodiment. However, the tabs 44 are positioned further inboard of a support sheet 236 such that comer tabs 44 support the display sheet 238 in a fixed display location which corresponds to the location of the transparent plastic sheet 210. Additional tabs 44 are also positioned in between the comer tabs 44 along the top and bottom sides of the support sheet 236. The embodiment illustrated in FIG. 8 may include a spine pocket (not shown) and spine tab assembly (not shown) as described in the previous embodiments.

Although the present invention has been described in detail with regarding the exemplary embodiments and drawings thereof, it should be apparent to those skilled in the art that various adaptations may be accomplished without departing from the spirit and scope of the invention. For instance, a support sheet can have as few as or more than two tabs 44. Furthermore, a generic type support sheet can have tabs 44 positioned in key locations to accommodate the securement of display sheets with several different shapes and/or sizes. The support sheet can also have tabs 44 arranged in a manner which allows the securement of several display sheets on a single support sheet.

The presentation frames described above can be configured with shorter or longer frame widths to define smaller or larger presentation openings. In addition, presentation frames can be non-rectangularly shaped to define presentation openings which are circular, oval, square, star-like, or any other shape. A presentation frame can also have several sub-presentation frames when several display sheets are presented on a single tab assembly.

The foregoing detailed description and the accompanying drawings describe illustrative preferred embodiments of the invention. Other arrangements may be provided along the same likes. Thus, by way of example and not of limitation, a tab assembly similar to the tab assemblies described above can be inserted into transparent sheet protectors which are commonly used for loose leaf binders. Further, a tab assembly can also be secured to a magnetic vertical surface such as a refrigerator door, wherein the tab assembly is placed between a frame which may be formed of a flexible permanent magnet material and the surface of the refrigerator door. Accordingly, the invention is not limited to the precise embodiment shown in the drawings and described in detail hereinabove.

What is claimed is:

1. A centering tab assembly comprising:

a support sheet;

a display sheet overlying and supported by said support sheet, said display sheet being smaller than said support sheet;

said support sheet having a plurality of centering tabs cut into said support sheet for supporting said display sheet in a fixed position relative to said support sheet.

2. A centering tab assembly as defined in claim 1, wherein said plurality of centering tabs are arcuate and extend toward said display sheet.

3. A centering tab assembly as defined in claim 1, further comprising a flat frame sheet for covering the periphery of said display sheet, and providing both a framing function and also concealing said centering tabs, wherein said centering tabs are positioned along the periphery of said support sheet.

4. A centering tab assembly as defined in claim 3, further comprising:

a first transparent sheet and a second sheet generally coextensive with said first sheet, said transparent sheet and said second sheet being secured to each other on three sides and having an opening on the fourth side thereof to form a pocket; and said support sheet having dimensions slightly smaller than said pocket.

5. A centering tab assembly as defined in claim 1, including at least three centering tabs.

6. A centering tab assembly as defined in claim 5, wherein said centering tabs are located on at least three sides of said display sheet.

7. A ring binder assembly comprising:

a ring binder including front and rear covers, said covers having predetermined length and width dimensions;

additional sheet material having at least a transparent central section secured to said front cover, sa d additional sheet material being secured to a cover to form a pocket;

a large support sheet having dimensions smaller than said pocket; and said support sheet having a plurality of cuts in said support sheet for supporting said display sheet and holding it in a fixed display location relative to said support sheet; and said assembly including frame sheet material for covering at least a portion of the periphery of said support sheet, and providing both a framing function and also concealing said cuts.

8. A binder as defined in claim 7, wherein said predetermined width and length of said covers are substantially greater than 8½ inches by 11 inches, said large support sheet has dimensions approximately equal to or slightly less than said predetermined width and height, and said display sheet has dimensions of about 8½ inches by 11½ inches.

9. A binder as defined in claim 7, wherein said plurality of cuts are arcuate.

10. A binder as defined in claim 7, wherein said transparent central section entirely covers said front cover in a manner which allows the entire support sheet arrangement to be viewable through said transparent central section.

11. A binder as defined in claim 10, further comprising:

an additional frame sheet for providing a framing function, wherein the exterior dimensions of said additional frame sheet are less than the exterior dimensions of said frame sheet material, and the interior dimensions of said additional frame sheet are less than the interior dimensions of said frame sheet material; and the frame widths of said frame sheet material and said additional frame sheet are at least ½ inch.

12. A binder as defined in claim 7, wherein said transparent section is approximately 3½ inches by 5 inches, and including a display sheet, and wherein said tabs are positioned on said support sheet in a manner which positions said display sheet for viewing through said transparent section.

13. A binder assembly comprising:

a front cover;

a rear cover;

a spine hingedly coupled to said front and rear covers;

transparent plastic sheet secured to said front cover, said transparent plastic sheet being secured to a cover and having an opening, and the sheet and cover forming a pocket;

a support sheet having dimensions smaller than said pocket;

a display sheet overlying and supported by said support sheet, said display sheet being smaller than said support sheet;

said support sheet having a plurality of cuts in said support sheet for supporting said display sheet and holding it in a preferred position.

14. A binder assembly as defined in claim 13, further comprising a ring binder support with a plurality of rings, wherein said ring binder support is secured to said spine or said rear cover.

15. A binder assembly as defined in claim 13, further comprising a frame sheet for covering the periphery of said display sheet, and providing both a framing function and also concealing said tabs.

16. A binder assembly as defined in claim 15, further comprising an additional frame sheet for providing a framing function, wherein the exterior dimensions of said additional frame sheet are less than the exterior dimensions of said frame sheet, and the interior dimensions of said additional frame sheet are less than the interior dimensions of said frame sheet.

17. A binder assembly as defined in claim 13, wherein said plurality of cuts are positioned near each comer of said support sheet.

18. A binder assembly as defined in claim 13, wherein said plurality of cuts are arcuate and extend toward said display sheet.

19. A binder assembly as defined in claim 13, wherein said front cover, said rear cover and said support sheet have dimensions greater than 8½ inches by 11 inches.

20. A binder assembly as defined in claim 13 including at least three cuts.

21. A ring binder assembly comprising:

a ring binder including front and rear covers, said covers having predetermined length and width dimensions;

additional sheet material having at least a transparent central section secured to said front cover, said additional sheet material being secured to said front cover to form a pocket;

a large support sheet having dimensions smaller than said pocket; and a display sheet overlying and supported by said support sheet, said display sheet being substantially smaller than said support sheet;

said support sheet having a plurality of cuts in said support sheet for supporting said display sheet and holding it in a fixed display location relative to said support sheet; and said assembly including frame sheet material for covering at least a portion of the periphery of said display sheet and providing a framing function.

22. A ring binder assembly comprising:

a ring binder including front and rear covers, said covers having predetermined length and width dimensions;

additional sheet material having at least a transparent central section secured to said front cover, said additional sheet material being secured to said front cover to form a pocket;

a large support sheet having dimensions smaller than said pocket; and said support sheet having a plurality of cuts in said support sheet for supporting said display sheet and holding it in a fixed display location relative to said support sheet; and said assembly including frame sheet material for covering at least a portion of said cuts.

* * * * *